US009405222B2

(12) United States Patent
Kojo

(10) Patent No.: US 9,405,222 B2
(45) Date of Patent: Aug. 2, 2016

(54) IMAGE FORMING APPARATUS, TONER STORAGE MEMBER AND METHOD OF CONTROLLING IMAGE FORMING APPARATUS

(71) Applicant: KYOCERA Document Solutions Inc., Osaka (JP)

(72) Inventor: Hidehiko Kojo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/924,198

(22) Filed: Oct. 27, 2015

(65) Prior Publication Data

US 2016/0124344 A1 May 5, 2016

(30) Foreign Application Priority Data

Oct. 31, 2014 (JP) ..... 2014-223361

(51) Int. Cl.
*G03G 15/00* (2006.01)
*G03G 15/08* (2006.01)

(52) U.S. Cl.
CPC ..... *G03G 15/0863* (2013.01); *G03G 15/0856* (2013.01); *G03G 15/556* (2013.01); *G03G 15/0879* (2013.01)

(58) Field of Classification Search
CPC ..... G03G 15/0886; G03G 15/0863; G03G 15/0865; G03G 15/0868; G03G 15/553; G03G 2215/0668; G03G 2215/0692; G03G 2215/0697; G03G 15/55; G03G 21/1652; G03G 15/0879; G03G 21/1875
See application file for complete search history.

(56) References Cited

U.S. PATENT DOCUMENTS

2006/0283933 A1* 12/2006 Ueda ..... H04N 1/2346 235/375
2012/0020678 A1* 1/2012 Wilsher ..... G03G 15/553 399/12
2012/0051781 A1* 3/2012 Kubo ..... G03G 21/1867 399/111
2012/0243887 A1* 9/2012 Murata ..... G03G 15/0858 399/27
2013/0108285 A1* 5/2013 Spink ..... G03G 15/556 399/24

FOREIGN PATENT DOCUMENTS

JP 2013-3375 A 1/2013

* cited by examiner

*Primary Examiner* — Roy Y Yi
(74) *Attorney, Agent, or Firm* — Stein IP, LLC

(57) ABSTRACT

An image forming apparatus includes a toner storage member which includes a substrate portion and which supplies a toner, a terminal portion and a determination portion. The substrate portion is one substrate which includes a remaining amount detection portion and a memory. The remaining amount detection portion includes a detection circuit which outputs a voltage corresponding to the remaining amount of toner. The memory stores an output value (empty output value) of the detection circuit when the toner storage member is in an empty state. The determination portion compares the empty output value with the output value of the detection circuit to determine whether or not the toner storage member is in the empty state.

14 Claims, 7 Drawing Sheets

IMAGE FORMING APPARATUS, TONER STORAGE MEMBER AND METHOD OF CONTROLLING IMAGE FORMING APPARATUS

The present application is based upon and claims the benefit of priority from the corresponding Japanese Patent Application No. 2014-223361 filed on Oct. 31, 2014, the entire contents of which are incorporated herein by reference.

BACKGROUND

The present disclosure relates to a toner storage member that stores a toner, an image forming apparatus that includes a toner storage member and a method of controlling an image forming apparatus.

In some image forming apparatuses such as a multifunctional peripheral and a printer, printing is performed with a toner. A toner storage member (which may also be referred to as a "toner container" or a "toner cartridge") that stores a toner is attached to such an image forming apparatus. The toner storage member may be counterfeited by a third party other than the manufacturer thereof. In a non-genuine toner storage member, an inferior toner may be used. In order to prevent a failure in an image forming apparatus, the use of a genuine toner storage member is recommended. However, a non-genuine toner storage member may be put into the market and used. Hence, the following image forming apparatus is known which prevents easy replication and in which whether or not a toner storage member is genuine is determined.

Specifically, an image forming apparatus is known which includes: a toner storage portion that stores a toner; an engine portion that utilizes the toner supplied from the toner storage portion to form an image; a plurality of agitation members in which at least part of the agitation member is formed of a magnetic material and in which the agitation member is rotated and moved within the toner storage portion to agitate the toner; a detection portion that is arranged outside the toner storage member and that detects the permeability of each of the agitation members where at least part of the agitation member is formed of the magnetic material; and a determination portion that determines, based on the permeability detected by the detection portion, whether or not the toner storage portion is genuine.

In an image forming apparatus, a chip such as an IC tag may be provided which stores information (security information) for determining whether or not a toner storage member is genuine. The image forming apparatus reads the information stored in the chip. Then, whether the information can be acquired and whether the acquired information is appropriate are checked, and thus whether or not the toner storage member is genuine is determined.

In an image forming apparatus, a sensor for detecting the amount of toner left in a toner storage member may also be provided. Based on an output value of the sensor, the image forming apparatus detects the remaining amount of toner in the toner storage member and whether or not the toner storage member is empty (the remaining amount is zero).

Conventionally, the chip and the sensor described above are provided as separate substrates. Furthermore, a circuit for communication with the sensor substrate, a circuit for communication with the chip substrate and the wiring thereof are needed. As described above, since the chip and the sensor are provided as separate substrates, it is disadvantageously difficult to reduce the manufacturing cost of the image forming apparatus and the toner storage member.

As the remaining amount of magnetic material toner is decreased, the permeability in the vicinity of a toner storage member is decreased. Hence, a circuit which includes an element such as a differential transformer whose output is changed according to the permeability and whose output is changed according to the permeability can be used as a remaining amount detection sensor. However, when the position of the element or the circuit whose output is changed according to the permeability is displaced, even if the remaining amount of toner within the toner storage member is the same, a difference in the output value from the circuit is disadvantageously produced. Hence, variations in the output value of the circuit in an empty state are produced according to the position of the circuit. As described above, the element and the circuit whose output is changed according to the permeability are affected by the position where they are attached. Thus, it may be disadvantageously difficult to accurately detect the remaining amount of toner and the empty state.

Furthermore, an attempt to utilize the characteristic of the circuit described above to more accurately determine whether or not the attached toner storage member is genuine is not conventionally made.

In the known technology described above, with the agitation members for agitating the toner, it is possible to determine whether or not the toner storage member is genuine. However, the technology cannot cope with the problem in which the manufacturing cost is increased by providing the sensor and the chip separately and the problem in which the element (circuit) for detecting the permeability whose output is changed by the position where the element is attached.

SUMMARY

An image forming apparatus according to one aspect of the present disclosure includes a print portion, a toner storage member, a terminal portion, a determination portion and a notification portion. The print portion performs printing with a toner. The toner storage member is removable with respect to the image forming apparatus, has a substrate portion attached and supplies the toner to the print portion. The terminal portion communicates with the substrate portion. The determination portion determines, based on information received with the terminal portion from the toner storage member, whether or not the toner storage member is a genuine product and detects the remaining amount of the toner in the toner storage member. The notification portion notifies the state of the apparatus. The substrate portion is one substrate which includes a communication terminal portion in contact with the terminal portion, a remaining amount detection portion and a memory. The remaining amount detection portion includes a differential transformer and a detection circuit which processes an output of the differential transformer to output a voltage corresponding to the remaining amount. The memory stores security information for determining whether or not the toner storage member is the genuine product and an empty output value indicating an output value of the detection circuit when the toner storage member is in an empty state. The communication terminal portion transmits details stored in the memory to the determination portion and inputs the output value of the detection circuit to the determination portion. The determination portion recognizes a magnitude of the output value of the detection circuit and compares the empty output value stored in the memory with the output value of the detection circuit to determine whether or not the toner storage member is in the empty state. When the determination portion determines that the toner storage member is in the empty state, the notification portion notifies information that the toner storage member is empty.

Further features and advantages of the present disclosure will become more obvious from embodiments described below.

DETAILED DESCRIPTION

The present disclosure relates to an image forming apparatus and a toner storage member that can accurately detect the remaining amount of toner and an empty state while reducing the manufacturing cost thereof and the promotion of use of genuine products. An embodiment of the present disclosure will be described with reference to FIGS. 1 to 10. A description will be given below using, as an example, a printer 100 (which corresponds to an image forming apparatus) that includes a toner container 1 (which corresponds to a toner storage member) storing a magnetic material toner and that uses the magnetic material toner in the toner container 1 to perform printing. However, elements such as configurations and arrangements described in the embodiment do not limit the scope of the disclosure, and are simply illustrative.

(Outline of the Printer 100)

Figure 1:
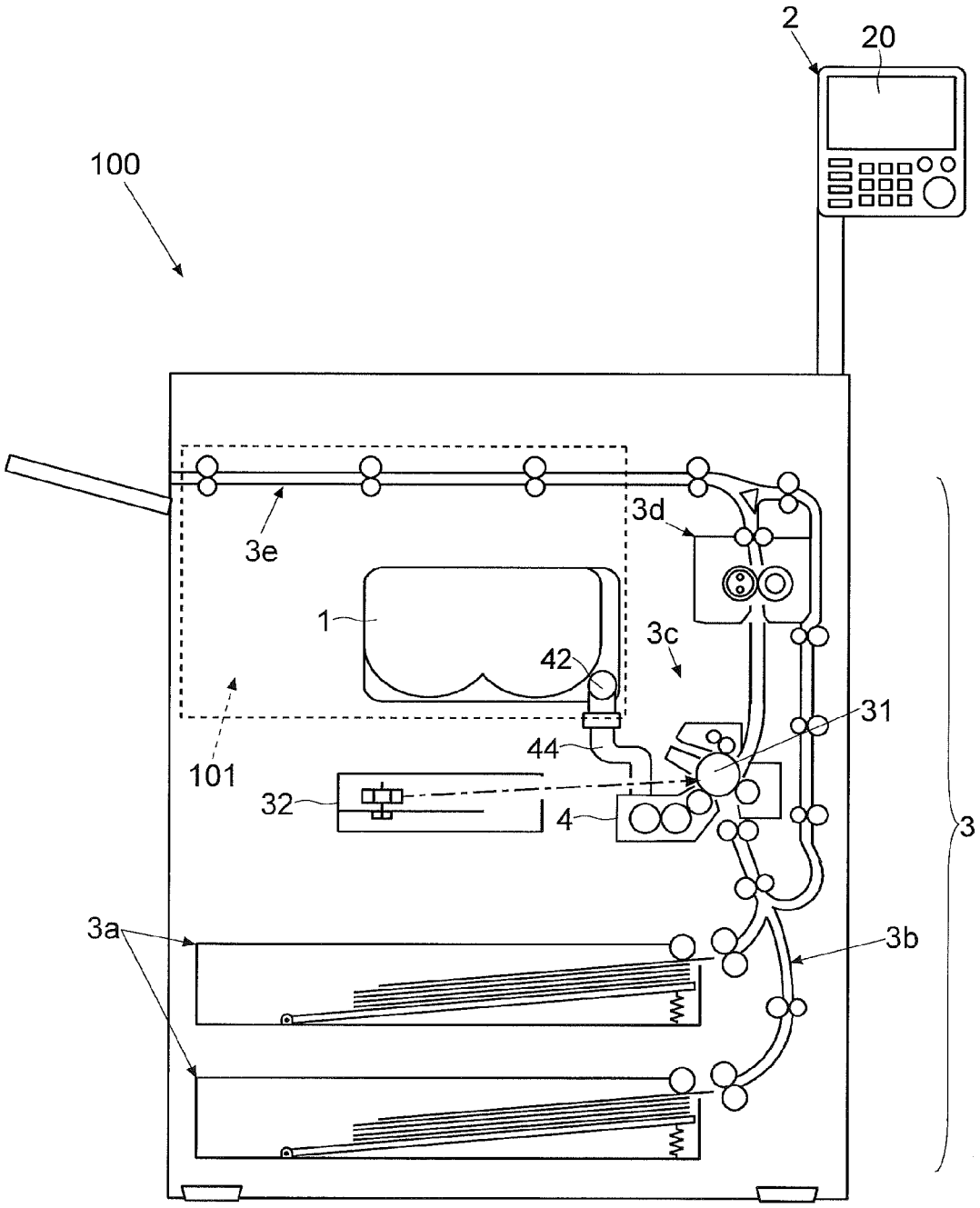
FIG. 1 is a diagram showing an example of a printer according to an embodiment.

The outline of the printer 100 according to the embodiment will first be described with reference to FIG. 1. As shown in FIG. 1, the printer 100 of the present embodiment includes an operation panel 2. The printer 100 has a print portion 3 therewithin. The print portion 3 includes a paper feed portion 3*a*, a first transport portion 3*b*, an image formation portion 3*c*, a fixing portion 3*d* and a second transport portion 3*e*.

The operation panel 2 includes a display panel 20 (which corresponds to a notification portion) that notifies the state of the printer 100. The display panel 20 displays (notifies) the remaining amount of toner in the toner container 1, the empty state of the toner container 1 and information that the toner container 1 is non-genuine. The operation panel 2 receives various types of setting operations on the printer 100.

The paper feed portion 3*a* of the print portion 3 stores a plurality of sheets, and feeds out the sheet at the time of printing. The first transport portion 3*b* transports the sheet supplied from the paper feed portion 3*a* to the image formation portion 3*c*. The image formation portion 3*c* includes a development device 4 that develops, based on image data printed, with the toner, an electrostatic latent image formed by an exposure device 31 on the circumferential surface of a photosensitive drum 32. The image formation portion 3*c* transfers the toner image to the sheet. The development device 4 receives the supply of the toner from the toner container 1 when printing is performed. The fixing portion 3*d* heats and pressurizes the sheet to which the toner image is transferred to fix the toner image on the sheet. The second transport portion 3*e* ejects the sheet passed through the fixing portion 3*d* to the outside of the apparatus.

(Hardware Configuration of the Printer 100)

Figure 2:
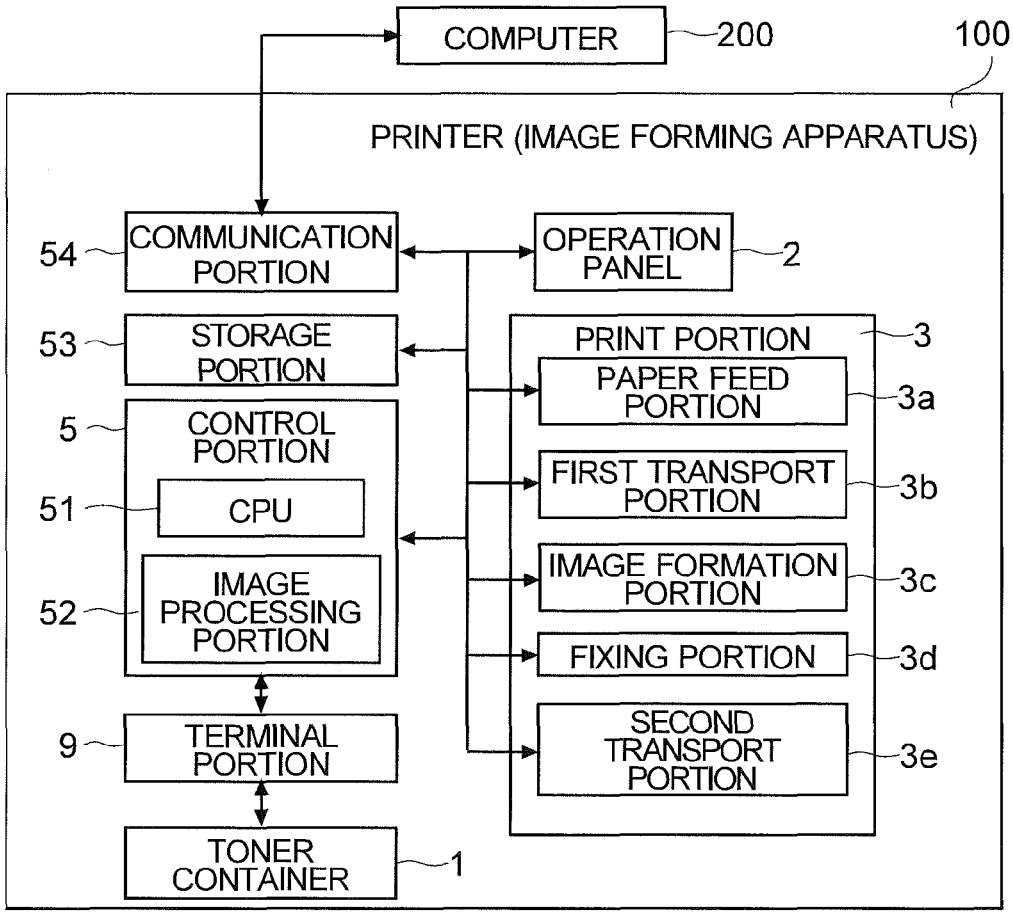
FIG. 2 is a diagram showing the hardware configuration of the printer according to the embodiment.

The hardware configuration of the printer 100 according to the embodiment will then be described with reference to FIG. 2. As shown in FIG. 2, the printer 100 includes a control portion 5 (which corresponds to a determination portion). The control portion 5 controls the individual portions of the printer 100. The control portion 5 communicates with various types of substrates within the printer 100 and receives the outputs of sensors to perform various types of detection. The control portion 5 includes a CPU 51, an image processing portion 52 that performs image processing on image data used in printing and other electronic circuits and elements. The CPU 51 performs control and computation on the individual portions of the printer 100 based on control programs and control data stored in a storage portion 53. The storage portion 53 is a combination of a nonvolatile storage device such as a ROM, a flash ROM or a HDD and a volatile storage device such as a RAM.

The control portion 5 controls the operation of the print portion 3 (the paper feed portion 3*a*, the first transport portion 3*b*, the image formation portion 3*c*, the fixing portion 3*d* and the second transport portion 3*e*). Then, based on print data received from a computer 200, the control portion 5 makes the print portion 3 perform printing. The control portion 5 controls the operation of the operation panel 2. The control portion 5 recognizes the details of an operation and a setting performed on the operation panel 2 and recognizes instructions to perform the details of the setting and printing.

A communication portion 54 is connected to the control portion 5. The control portion 5 controls the operation of the communication portion 54 and communication processing. The communication portion 54 is an interface for communicating with the computer 200 such as a personal computer or a server. Based on the print data (data on image data and print settings) received by the communication portion 54, the control portion 5 makes the print portion perform printing.

(Outline of Toner Supply to the Development Device 4)

The outline of toner supply to the development device 4 in the present embodiment will then be described with reference to FIGS. 1 and 3.

The toner is consumed by printing. Hence, as shown in FIGS. 1 and 3, in the printer 100, the toner container 1 for supplying the toner to the development device 4 is provided. The toner container 1 stores the magnetic material toner (the toner of one component type). On the front surface of the printer 100, a front cover 101 is provided (see FIG. 1). An opening/closing detection sensor S1 for detecting the opening and closing of the front cover 101 is provided. An output of the opening/closing detection sensor S1 is input to the control portion 5. The control portion 5 recognizes, based on the output of the opening/closing detection sensor S1, whether the front cover 101 is opened or closed.

Through an opening appearing when the front cover 101 is opened, a user can attach and detach the toner container 1.

When the toner container 1 enters the empty state, the user replaces the toner container 1 with a new one. In the printer 100 of the present embodiment, an attachment/detachment detection sensor S2 for detecting the attachment and detachment of the toner container 1 is provided. An output of the attachment/detachment detection sensor S2 is input to the control portion 5. The control portion 5 recognizes, based on the output of the attachment/detachment detection sensor S2, whether the toner container 1 is detached or attached.

(Flow of Toner Supply)

Members related to the toner supply in the present embodiment and the basic flow of the toner supply will then be described with reference to FIGS. 1 and 3.

Figure 3:
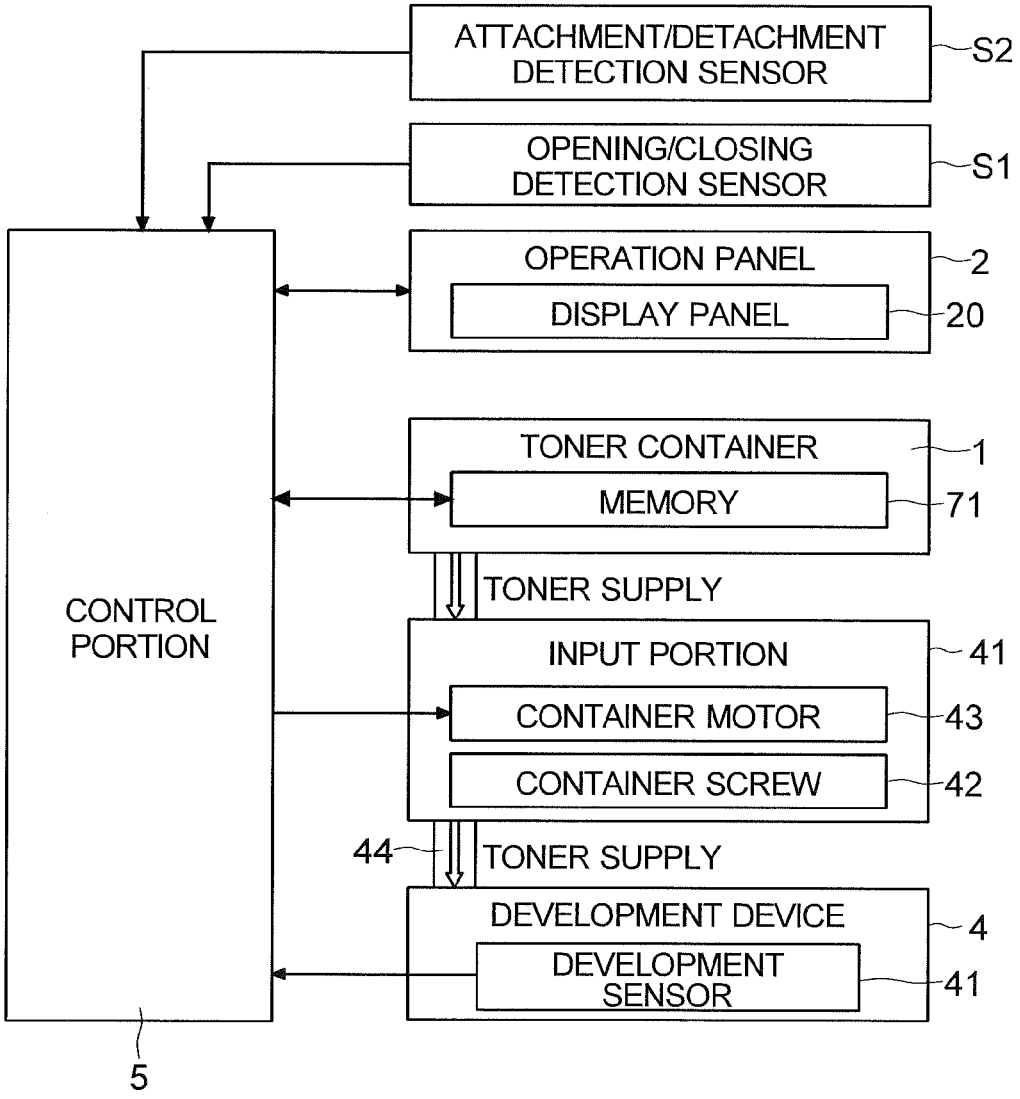
FIG. 3 is a diagram showing the hardware configuration of a part related to toner supply in the printer according to the embodiment.

In order to input the toner from the toner container 1 into the development device 4, as shown in FIG. 3, an input portion 41 is provided. The input portion 41 includes a container screw 42 that feeds out (inputs) the toner in the toner container 1 in the direction of the development device 4. The input portion 41 includes a container motor 43 that rotates the container screw 42. The input portion 41 includes an input pipe 44 which connects the container screw 42 and the toner input port of the development device 4 and through which the toner is passed (see FIG. 1).

The container screw 42 is provided below the toner container 1. The container screw 42 is provided to face a feed opening portion from which the toner in the toner container 1 is fed out. By the rotation of the container screw 42, the toner is input into the development device 4 through the input pipe 44.

When the toner is supplied to the development device 4, the control portion 5 rotates the container motor 43 to feed out the toner from the toner container 1. An agitation member (not shown) that is rotated within the toner container 1 and that loosens the toner within the toner container 1 may be provided. In a case where the agitation member is provided, the container motor 43 also rotates the agitation member.

A development sensor 41 for detecting whether or not the specified amount of toner is present (charged) in the development device 4 is provided within the development device 4. In the development sensor 41, an output is changed depending on whether the toner within the development device 4 is more than the specified amount or is equal to or less than the specified amount.

The control portion 5 receives the output of the development sensor 41 to recognize whether or not the toner within the development device 4 is equal to or less than the specified amount. When the control portion 5 recognizes that the toner within the development device 4 is decreased beyond the specified amount, the control portion 5 operates the input portion 41 (the container motor 43) to input the toner into the development device 4. Then, when the control portion 5 recognizes, based on the output of the development sensor 41, that the toner within the development device 4 reaches the specified amount, the control portion 5 stops the input portion 41 (the container motor 43).

(Communication Between the Main Body Side and the Toner Container 1)

Communication between the main body (the control portion 5) of the printer 100 according to the embodiment and a substrate portion provided in the toner container 1 will then be described with reference to FIGS. 4 to 6.

Figure 4:
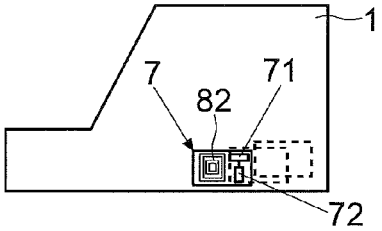
FIG. 4 is a schematic diagram showing an example of a substrate portion provided in a toner container.

As shown in FIG. 4, the substrate portion 7 is attached to the outside (the outer surface of a housing) of the toner container 1. In an example shown in FIG. 4, the substrate portion 7 is attached to one side surface of the toner container 1. The substrate portion 7 is one substrate.

Figure 5:
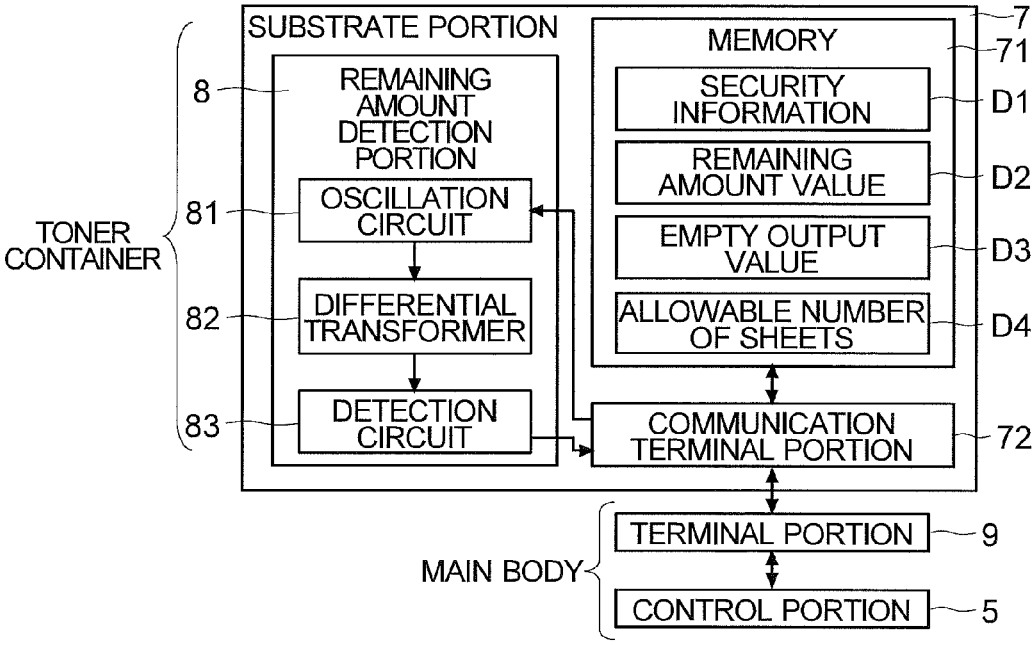
FIG. 5 is a diagram showing an example of a configuration for communication between a main body side and the substrate portion.
Figure 6:
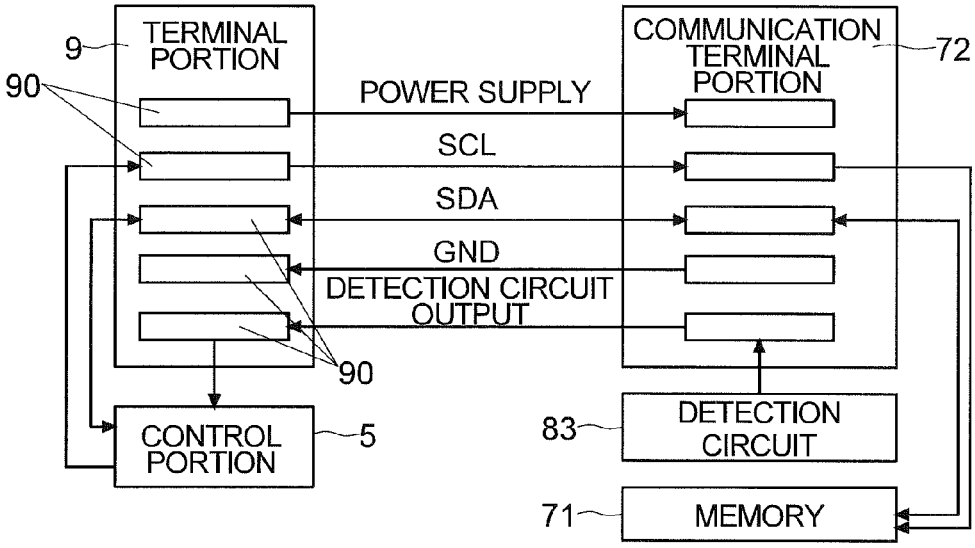
FIG. 6 is a diagram showing an example of a communication terminal in the embodiment.

As shown in FIG. 5, the substrate portion 7 includes a memory 71, a communication terminal portion 72 and a remaining amount detection portion 8. The communication terminal portion 72 is connected to a terminal portion 9 provided on the main body side. By connection between the communication terminal portion 72 of the toner container 1 and the terminal portion 9 on the main body side, it is possible to perform communication (the acquisition of signals and data) between the control portion 5 of the printer 100 and the memory 71 and the remaining amount detection portion 8 of the substrate portion 7. The terminal portion 9 of the printer 100 is provided in a position corresponding to (position in contact with) the communication terminal portion 72 of the toner container 1 attached to the interior of the printer 100.

In the terminal portion 9 and the communication terminal portion 72, a power supply terminal, a ground terminal, a serial clock terminal and a serial data terminal are provided. The power supply terminal and the ground terminal are terminals for supplying power to the memory 71 and the remaining amount detection portion 8 (an oscillation circuit 81, a differential transformer 82 and a detection circuit 83). The serial clock terminal is a terminal for inputting, to the substrate portion 7, a clock signal that is generated by the control portion 5 and that is supplied to the memory 71 and the oscillation circuit 81. The serial data terminal is a terminal for transmitting information (data) read from the memory 71 to the control portion 5 and for transmitting an instruction to the memory 71 and information (data) to be stored to the memory 71. In the data communication between the control portion 5 and the substrate portion 7, communication standards such as 12C are adopted. In the printer 100 (the terminal portion 9) and the substrate portion 7 (the communication terminal portion 72), a detection circuit output terminal is provided. The detection circuit output terminal is a terminal for inputting, to the control portion 5, the output value of the detection circuit 83 included in the remaining amount detection portion 8.

Here, the individual terminals of the terminal portion 9 on the main body side are plate springs 90 obtained by bending a conductive metal plate or a plate whose surface is covered with a conductive metal. When the toner container 1 is attached, the terminals of the terminal portion 9 and the terminals of the communication terminal portion 72 are reliably brought into contact by the elasticity of the plate springs 90. Hence, the occurrence of a contact failure in the terminals is prevented. The plate springs may instead be adopted as the terminals on the side of the communication terminal portion 72.

The remaining amount detection portion 8 is a circuit for detecting the amount of toner left in the toner container 1. As shown in FIG. 5, the remaining amount detection portion 8 includes the oscillation circuit 81, the differential transformer 82 and the detection circuit 83. The oscillation circuit 81 is a circuit that generates an AC voltage from a DC voltage supplied from the communication terminal portion 72 and that inputs it to the differential transformer 82. The differential transformer 82 is formed as a circuit pattern on the substrate portion 7. The differential transformer 82 includes a primary coil and two secondary coils (a detection coil and a reference coil), and outputs a voltage difference between the secondary coils. As the remaining amount of magnetic material toner is increased, the permeability around the differential transformer 82 is increased whereas as the remaining amount of magnetic material toner is decreased, the permeability around the differential transformer 82 is decreased. Based on a change in the permeability corresponding to the remaining amount of toner, the output of the differential transformer 82 is changed.

The detection circuit 83 is a circuit that processes and outputs an output (signal) of the differential transformer 82. The detection circuit 83 outputs a higher DC voltage as the remaining amount of toner is increased and outputs a lower DC voltage as the remaining amount of toner is decreased (for example, 2.5 V at the time of the filled state, 1.0 V at the time of the empty state). How the output of the differential transformer 82 is processed by the detection circuit 83 and what type of output is produced can be determined as necessary. For example, the detection circuit 83 may be a circuit that focuses on the point at which the amplitude and phase of the output voltage of the differential transformer 82 are changed according to the change in the remaining amount of toner (the change in the permeability). In this case, the detection circuit 83 may be a circuit that compares the phase of the output voltage of the differential transformer 82 with the phase of the AC voltage on the side of the primary coil, that generates a signal corresponding to the phase difference, that smooths out the generated signal and that outputs a DC voltage corresponding to the remaining amount of toner.

Through the communication terminal portion 72 and the terminal portion 9, the output voltage of the detection circuit 83 is input to the control portion 5. The control portion 5 determines the remaining amount of toner in the toner container 1 based on data that defines the magnitude of the output value (analogue voltage value) of the detection circuit 83 which is input and the remaining amount of toner corresponding to the magnitude of the output value of the detection circuit 83. The storage portion 53 (see FIG. 2) stores data that defines a value indicating a ratio of (current amount of toner)/(amount of toner at the time of the filled state) corresponding to the magnitude of the output value of the detection circuit 83.

The memory 71 stores security information D1. The security information D1 is information for determining, by the control portion, whether or not the toner container 1 is genuine. What type of information is set as the security information D1 can be determined as necessary. As the security information D1, information can be used that is obtained by encrypting information indicating the identification and function of the toner container 1 such as the manufacturing number, the manufacturing site, the manufacturing date, the model of the toner container 1, a toner charge date, a compatible model, the amount of toner in the filled state and the type of toner.

In the memory 71, a remaining amount value D2 of the toner in the toner container 1 (remaining amount data) is stored. The control portion 5 reads the remaining amount value D2 in the memory 71 to recognize the remaining amount value D2. As the toner is consumed, the control portion 5 transmits the current remaining amount value D2 to the memory 71 to update the remaining amount value D2 in the memory 71 (the details of which will be described later). The remaining amount value D2 can be set at the current output value of the detection circuit 83 which receives the input. Furthermore, a value indicating the remaining amount of toner determined by computation based on the output value of the detection circuit 83 may be stored.

Specifically, before the shipment of the toner container 1, the output value of the detection circuit 83 in the filled state is written in the memory 71 as the remaining amount value D2. In other words, the memory 71 stores the output value of the detection circuit 83 when the toner is charged (at the time of the filled state) as the initial value of the remaining amount value D2. Then, the toner container 1 is attached to the printer 100, and thereafter as the toner is consumed, the control portion 5 updates the remaining amount value D2 in the memory 71.

(Detection of the Remaining Amount of Toner in the Toner Container 1)

An example of the flow of detection of the remaining amount of toner in the toner container 1 will then be described with reference to FIGS. 4, 5, 7 and 8.

Figure 7:
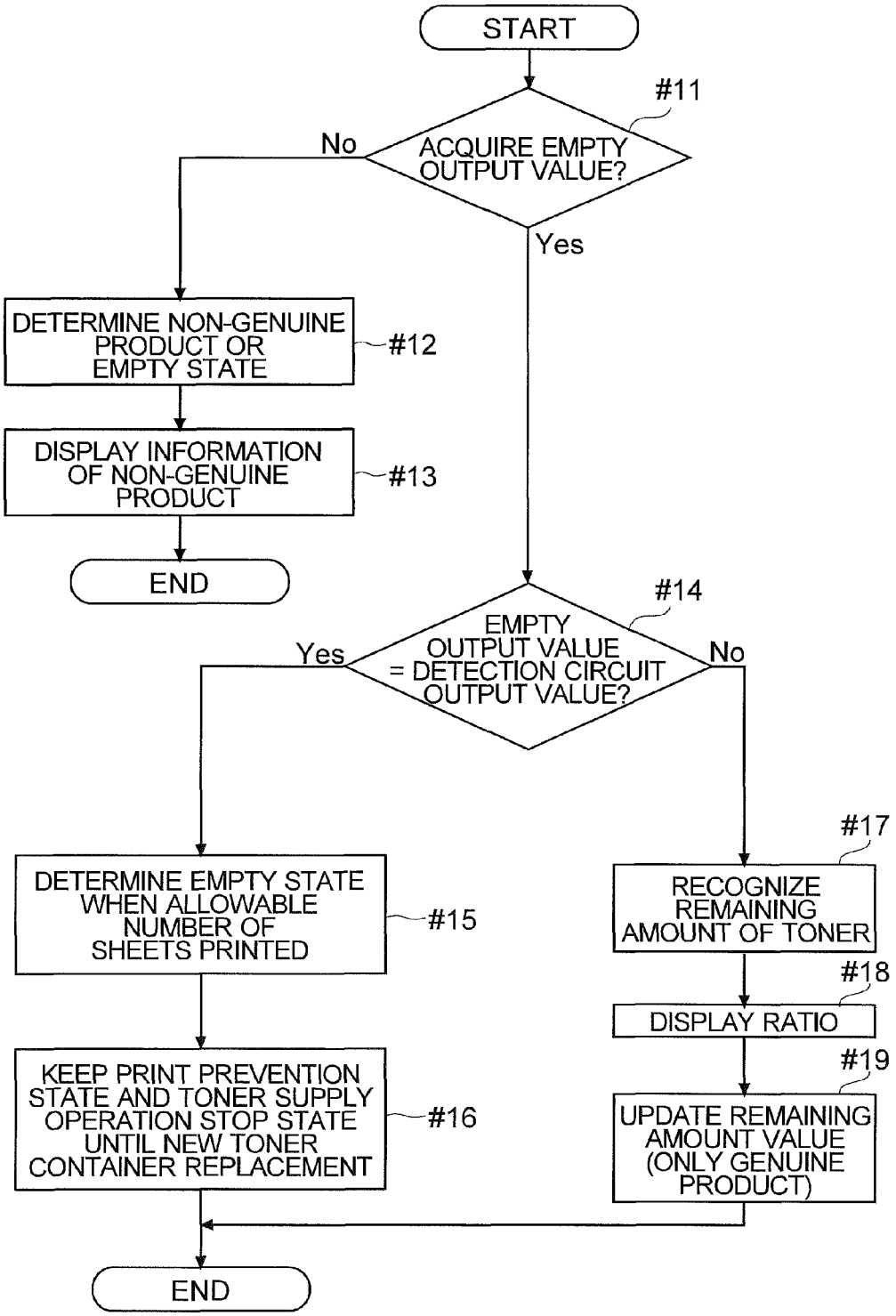
FIG. 7 is a flowchart showing an example of the flow of detection of the remaining amount of toner.
Figure 8:
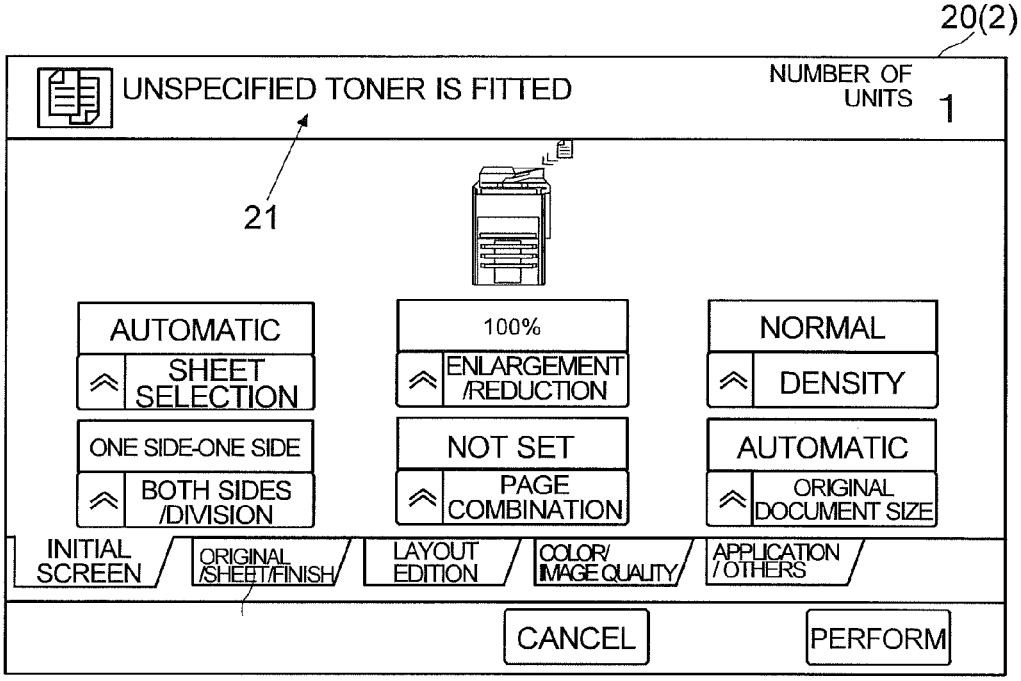
FIG. 8 is a diagram showing an example of a notification screen which notifies information that a toner container is determined to be non-genuine.

First, the start of FIG. 7 is a time when the remaining amount of toner in the toner container 1 is detected. The time when the remaining amount of toner is detected is previously determined. Examples of the time when the remaining amount of toner is detected include a time during which printing is being performed by the print portion 3 (the remaining amount of toner is detected at regular intervals), a time when the main power supply of the printer 100 is turned on, a time when the mode is returned from a power saving mode and a time when a new toner container 1 is attached. The start of FIG. 7 is a state where the toner container 1 to which the substrate portion 7 is attached is fitted to the printer 100 and the control portion 5 and the substrate portion 7 can communicate with each other.

When the substrate portion 7 is not attached to the toner container 1 (when the remaining amount detection portion 8 and the memory 71 are not present), the control portion 5 cannot detect the empty state and the remaining amount. In this case, the control portion 5 determines that the toner container 1 is not present or that the toner container 1 is in the empty state. When it is impossible to communicate with the substrate portion 7 such that the presence of the substrate portion 7 cannot be recognized, the control portion 5 determines that the toner container 1 is not present or that the toner container 1 is in the empty state.

The control portion 5 (the CPU 51) inputs power and a clock signal to the substrate portion 7, reads an empty output value D3 stored in the memory 71 and checks whether or not the empty output value D3 can be acquired (step #11).

Here, the "empty output value D3" is previously stored in the memory 71 of the toner container 1 (see FIG. 5). The empty output value D3 is the output value of the detection circuit 83 when the toner container 1 is in the empty state (where the toner is not present and the remaining amount is zero). Before the shipment of and at the time of manufacturing of the toner container 1, the toner container 1 before the toner is charged is set to the printer 100. Then, the control portion 5 recognizes the output value (analogue voltage value) of the detection circuit 83 at that time by AD conversion or the like. The control portion 5 stores the recognized output value of the detection circuit 83 in the memory 71 as the empty output value D3.

In the toner container 1 of the present embodiment, as part of the remaining amount detection portion 8, the differential transformer 82 is provided. However, when the position of the differential transformer 82 on the substrate or the position where the substrate portion 7 is placed is displaced, the output of the detection circuit 83 is affected by such a displacement. Then, in the toner container 1 of the present embodiment, in each toner container 1, variations in the position where the substrate portion 7 is attached and the position of the differential transformer 82 within the substrate portion 7 are intentionally produced. In other words, a plurality of patterns of the position where the substrate portion 7 is attached or the position where the differential transformer 82 is formed within the substrate portion 7 are prepared (see FIG. 4, and the pattern of the position where the substrate portion 7 is attached is indicated by broken lines as an example). Regardless of the position where the substrate portion 7 is attached, the terminal portion 9 may be movable such that the terminal portion 9 appropriately makes contact with the communication terminal portion 72 or a guide for the terminal portion 9 may be provided such that the terminal portion 9 appropriately makes contact with the communication terminal portion 72.

As described above, in the toner container 1 of the present embodiment, variations in the position of the differential transformer 82 and differences in the position where the substrate portion 7 is attached are produced, and thus the empty output values D3 of all the toner containers 1 are prevented from being the same. In the genuine toner container 1, in the memory 71, the appropriate empty output value D3 corresponding to the toner container 1 is stored. Thus, it is possible to reliably detect the empty state of the toner.

On the other hand, in a non-genuine toner container 1, there may be a case where the empty output value D3 is not present or the appropriate empty output value D3 corresponding to the position of the differential transformer 82 is not provided. When the appropriate empty output value D3 is not provided, though the toner is left, the empty state may be detected. Thus, it is possible to prevent a non-genuine product from achieving the same performance as the genuine toner container 1.

If the control portion 5 cannot acquire the empty output value D3 (no in step #11), the information stored in the memory 71 of the genuine product is not stored. Hence, when the empty output value D3 cannot be acquired (no in step #11), the control portion 5 determines that the toner container 1 is not genuine (step #12). The control portion 5 displays, in a message display column 21 provided within the screen of the display panel 20, information that the toner container 1 is not genuine (see FIG. 8). In the message display column 21, a warning message such as "a toner that is not specified is fitted" is displayed.

When the empty output value D3 cannot be acquired, the control portion 5 may determine that the toner container 1 is non-genuine and that the toner container 1 is in the empty state. This is because in the control portion 5, in the empty state, until the toner container 1 is replaced, the printing by the print portion 3 or the operation of toner supply by the input portion 41 is stopped. Hence, it is possible to prevent a failure caused by the use of a non-genuine toner. In this way, instead of the security information D1 in the memory 71, with the other information, it is possible to determine whether or not the toner container 1 is genuine. Thus, it is possible to more reliably determine whether or not the toner container 1 is genuine than the conventional method.

After step #12, the control portion 5 displays (notifies), on the display panel 20, information that the toner container 1 is non-genuine (step #13 end). On the other hand, when the empty output value D3 is acquired (yes in step #11), the control portion 5 checks whether or not the output value of the detection circuit 83 is equal to the empty output value D3 (step #14).

When the output value of the detection circuit 83 is equal to the empty output value D3 (yes in step #14), the control portion 5 determines that the toner container 1 is in the empty state (the remaining amount of toner in the toner container 1 is zero) when the printing of the allowable number of sheets D4 is performed by the print portion 3 after the output value of the detection circuit 83 becomes equal to the empty output value D3 (step #15).

Here, in the genuine product, the allowable number of sheets D4 may be changed according to the position (the magnitude of the empty output value D3) of the differential transformer 82. Depending on the position of the differential transformer 82, in a state where a small amount of toner is left, the output value of the detection circuit 83 may reach a lower limit value. In such a case, the toner in the toner container 1 is not used up. Hence, the allowable number of sheets D4 is changed according to the position of the differential transformer 82 such that in any genuine toner container 1, the toner is used up.

The control portion 5 keeps a state where the print portion 3 is prevented from performing printing without being operated, until the toner container 1 is newly replaced by the detection of the empty state (step #16). The control portion 5 also keeps a state where the input portion 41 is not operated and the operation of the toner supply is stopped (step #16). The control portion 5 can also detect the replacement with a new toner container 1 based on, for example, the fact that the output of the attachment/detachment detection sensor S2 and the security information D1 obtained when the control portion 5 communicates with the toner container 1 differ from those of the toner container 1 which was fitted before. Then, the flow is completed.

If the output value of the detection circuit 83 is not equal to the empty output value D3 (no in step #14), the control portion 5 recognizes the remaining amount of toner within the toner container 1 based on the output value of the detection circuit 83 (step #17). The output value of the detection circuit 83 is increased as the remaining amount of toner is increased. Hence, the control portion 5 determines a ratio of the absolute value of a difference between the current output value of the detection circuit 83 and the empty output value D3 to the absolute value of a difference between a value (which is higher than the empty output value D3) previously determined as the output value of the detection circuit 83 when the toner container 1 is in the filled state and the output value of the detection circuit 83 (determines what percentage of the toner is left). Then, the control portion 5 displays (notifies), as a value indicating the remaining amount of toner, the ratio on the display panel 20 (step #18). The ratio may be displayed in a specific region on the display panel 20 in a fixed manner or the ratio may be displayed when a specific operation is performed on the operation panel 2.

Then, the control portion 5 transmits the remaining amount value D2 to the memory 71 of the toner container 1 to update the remaining amount value D2 of the memory 71 (step #19). Then, the flow is completed (end). The control portion 5 makes the memory 71 update the remaining amount value D2 only when the attached toner container 1 is genuine.

(Determination of Whether or not the Toner Container 1 is Genuine Based on the Security Information D1)

Figure 9:
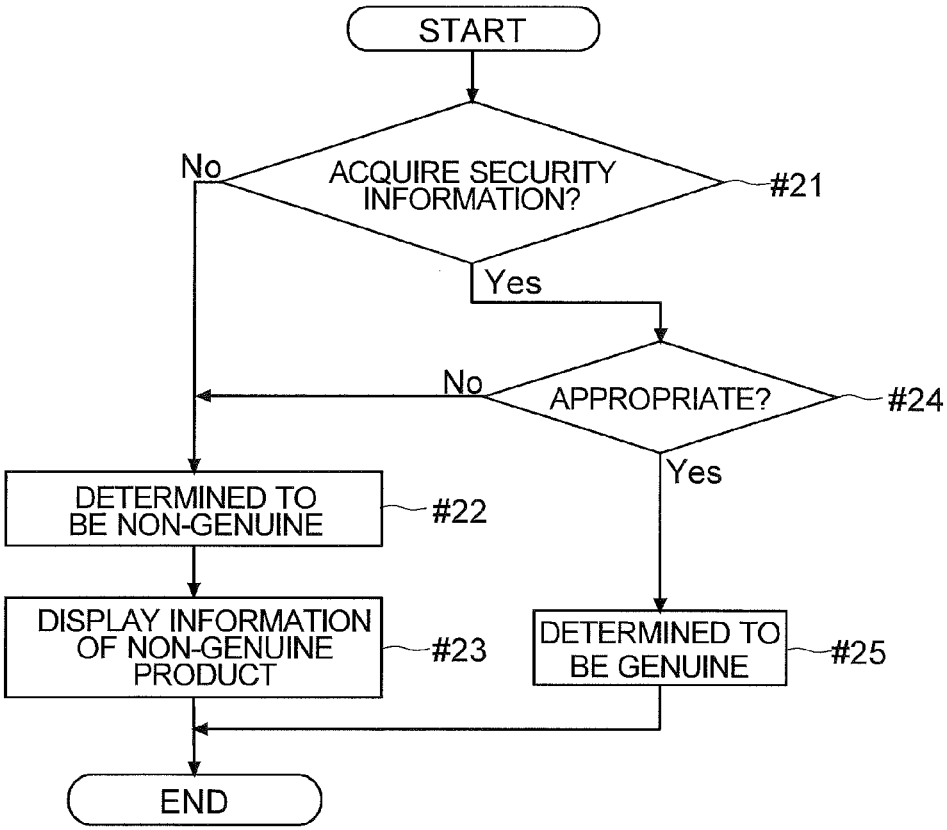
FIG. 9 is a flowchart showing an example of a determination based on security information stored in the toner container.

The determination based on the security information D1 of the toner container 1 according to the embodiment will then be described with reference to FIG. 9. First, the start of FIG. 9 is a time that is previously determined as the time when based on the security information D1, whether or not the toner container 1 is genuine is determined. At previously determined times when the main power supply is turned on, the mode is returned from the power saving mode and a new toner container 1 is attached, the determination based on the security information D1 is performed.

The control portion 5 first communicates with the substrate portion 7 of the toner container 1 to check whether or not the security information D1 is acquired (step #21). When the control portion 5 cannot communicate with the memory 71 of the substrate portion 7 (cannot receive a response), for example, because the substrate portion 7 itself is not present, the control portion 5 determines that the toner container 1 is not attached or that the toner container 1 is in the empty state. Then, when the control portion 5 cannot communicate with the memory 71 of the substrate portion 7, the control portion 5 keeps the state where the printer 100 is prevented from performing printing and the state where the operation of the toner supply to the development device 4 is stopped. Consequently, a counterfeit product in which the substrate portion 7 is not present and an inferior toner is highly likely to be stored cannot be used.

Although the presence of the memory 71 is recognized, when the security information D1 cannot be acquired (no in step #21), it is impossible to determine whether or not the toner container 1 is suitable for the printer 100. Hence, the control portion 5 determines that the toner container 1 is non-genuine (step #22). Then, the control portion 5 displays (notifies), on the display panel 20, information that the toner container 1 is not genuine (step #23). Then, the present flow is completed (end). When the control portion 5 determines that in step #22, the toner container 1 is non-genuine, the control portion 5 may recognize that the toner container 1 is in the empty state.

On the other hand, when the security information D1 is acquired (yes in step #21), the control portion 5 checks whether or not the acquired security information D1 is suitable (step #24). The types of information included in the security information D1 and the range of the acquired values are previously specified. Hence, the control portion 5 determines, by whether or not they follow the specifications, whether the security information D1 is appropriate or abnormal.

When an abnormal value is included (when the security information D1 is not appropriate; no in step #24), the control portion 5 determines that the toner container 1 is non-genuine (to step #22). On the other hand, when the security information D1 is appropriate, the control portion 5 determines that the toner container 1 is genuine (step #25). Then, since it is not necessary to issue a warning to the user, the flow is completed (end).

(Determination when a New Toner Container 1 is Attached)

A determination when a new toner container 1 is attached will then be described with reference to FIG. 10.

The security information D1 stored in the memory 71 may be analyzed. Hence, when the processing for confirming the security information D1 is performed, the possibility that a counterfeit product which is not determined as a non-genuine product is manufactured is not zero. Thus, in the printer 100 of the present embodiment, based on the output value of the detection circuit 83 when the toner container 1 is attached, the control portion 5 finds out that a newly attached toner container 1 is counterfeit.

Figure 10:
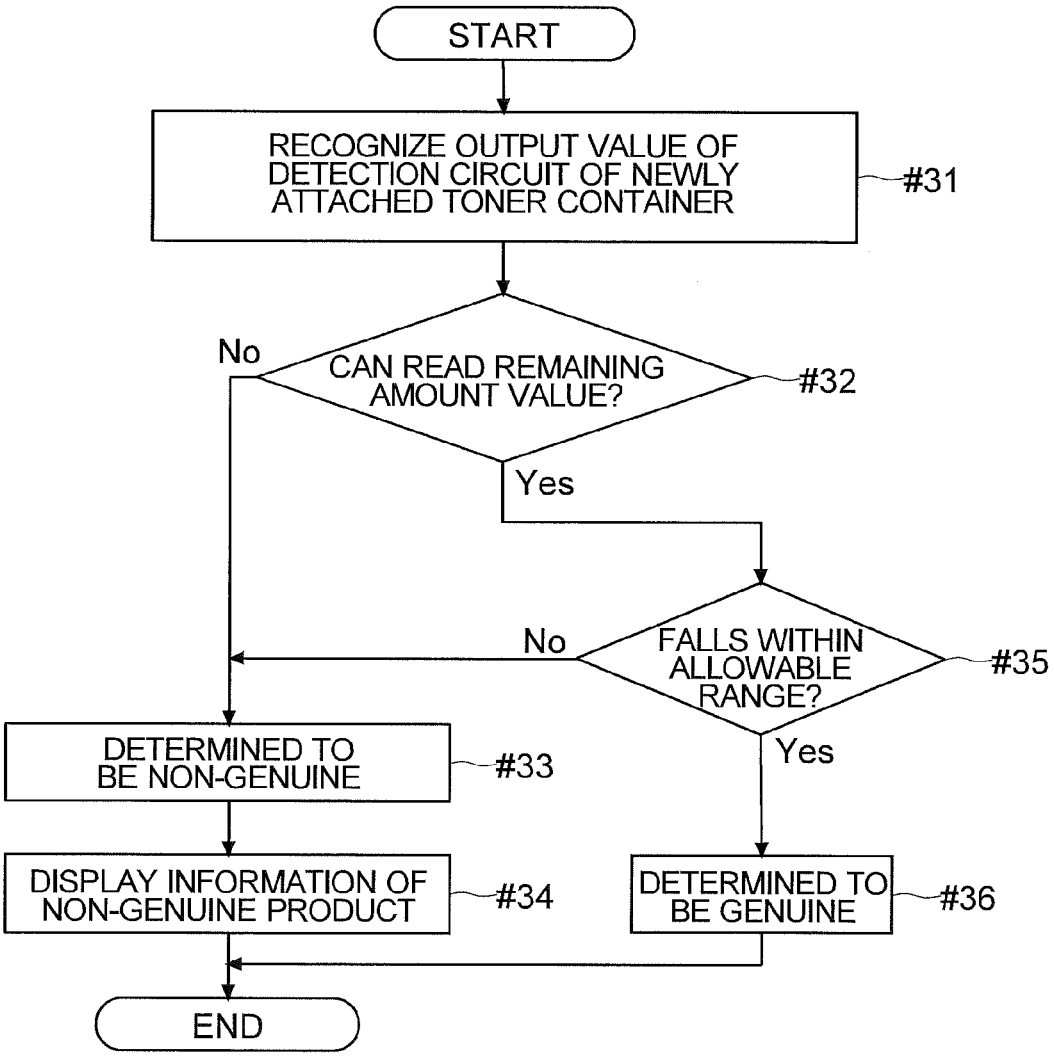
FIG. 10 is a flowchart showing an example of the flow of a determination when a new toner container is attached.

First, the start of FIG. 10 is a time when the control portion 5 recognizes the attachment of a new toner container 1. The determination based on the security information D1 shown in FIG. 9 is also performed when a new toner container 1 is attached. Hence, the control portion 5 performs the flow shown in FIG. 10 parallel to the flow of FIG. 9. Only when in all the flowcharts, the toner container 1 is determined not to be non-genuine, the control portion 5 deals with the attached toner container 1 as the genuine product. When in any one of the flowcharts, the toner container 1 is determined to be non-genuine, the control portion 5 deals with the attached toner container 1 as a non-genuine product.

As described previously, the control portion 5 can recognize, with the sensor (attachment/detachment detection sensor S2) for detecting the attachment and detachment of the toner container 1, that a new toner container 1 is attached. When the control portion 5 reads security information D1 that differs from the security information D1 on the toner container 1 which was attached before, the control portion 5 can recognize that a new toner container 1 is attached.

The control portion 5 recognizes the output value of the detection circuit 83 of the toner container 1 (the substrate portion 7) (step #31). The control portion 5 also checks whether or not the proper remaining amount value D2 can be read from the memory 71 (step #32).

In the memory 71 of the toner container 1 of the genuine product, the initial value (the initial value at the time of the filled state) of the remaining amount value D2 is stored. Hence, when the remaining amount value D2 cannot be read or when an abnormal remaining amount value D2 in which all the values of the digits of the data of the remaining amount value D2 are zero or one is read (when the proper remaining amount value D2 cannot be read from the memory 71; no in step #32), the control portion 5 determines that a newly attached toner container 1 is non-genuine (step #33). Then, the control portion 5 displays (notifies), on the display panel 20, information that the toner container 1 is non-genuine (step #34). Then, the present flow is completed.

On the other hand, when the proper remaining amount value D2 is read from the memory 71 (yes in step #32), the control portion 5 checks whether or not a difference between the remaining amount value D2 stored in the memory 71 and the recognized current output value of the detection circuit 83 falls within an allowable range (step #35).

The output value of the detection circuit 83 is affected by the position of the differential transformer 82. By utilizing this, it is possible to determine whether or not the toner container 1 is genuine. In the toner container 1 used in the printer 100 of the present embodiment, a plurality of patterns of the position where the substrate portion 7 is attached, the position where the differential transformer 82 is formed within the substrate portion 7 and the amount of toner charged at the time of manufacturing are provided. In other words, variations in the position of the differential transformer 82 and the amount of toner at the time of the filled state are intentionally produced. In this way, variations are intentionally produced in the output value of the detection circuit 83 at the time of the toner-filled state.

Hence, when in a counterfeit product, a displacement is produced in any one of the amount of toner at the time of the filled state and the positon of the differential transformer 82, a displacement between the remaining amount value D2 stored in the memory 71 from the time of the filled state (from the time of the attachment) and the output value of the detection circuit 83 falls outside the allowable range. In this way, it is possible to find out a delicate counterfeit product.

When the difference falls within the allowable range (yes in step #35), the control portion 5 determines that a newly attached toner container 1 is genuine (step #36). Then, the present flow is completed. On the other hand, when the difference falls outside the allowable range (no in step #35), the flow is moved to step #33.

As described above, the image forming apparatus (the printer 100) according to the present embodiment includes the print portion 3 (the paper feed portion 3*a*, the first transport portion 3*b*, the image formation portion 3*c*, the fixing portion 3*d* and the second transport portion 3*e*), the toner storage member (the toner container 1), the terminal portion 9, the determination portion (the control portion 5) and the notification portion. The print portion 3 uses the toner to perform printing. The toner storage member is removable with respect to the image forming apparatus, has the substrate portion 7 attached thereto and supplies the toner to the print portion 3. The terminal portion 9 is provided to communicate with the substrate portion 7 attached to the toner storage member. The determination portion determines, based on the information received with the terminal portion 9 from the toner storage member, whether or not the toner storage member is genuine, and detects the remaining amount of toner in the toner storage member. The notification portion (the display panel 20) notifies the state of the apparatus. The substrate portion 7 is one substrate that includes the communication terminal portion 72 in contact with the terminal portion 9, the remaining amount detection portion 8 and the memory 71. The remaining amount detection portion 8 includes the differential transformer 82 and the detection circuit 83 that processes the output of the differential transformer 82 to output a voltage corresponding to the remaining amount. The memory 71 stores the security information D1 for determining whether or not the toner storage member is genuine and the empty output value D3 indicating the output value of the detection circuit 83 when the toner storage member is in the empty state. The communication terminal portion 72 transmits details stored in the memory 71 to the determination portion and inputs the output value of the detection circuit 83. The determination portion recognizes the magnitude of the output value of the detection circuit 83 and compares the empty output value D3 stored in the memory 71 with the output value of the detection circuit 83 to determine whether or not the toner storage member is in the empty state. When the determination portion determines that the toner storage member is in the empty state, the notification portion notifies information that the toner storage member is empty.

Conventionally, the memory 71 and the remaining amount detection portion 8 (the remaining amount detection sensor) are provided as separate substrates, and are attached to the toner storage member (the toner container 1). However, since they are formed into one substrate, it is possible to reduce the manufacturing cost. Conventionally, in the toner storage member storing the magnetic material toner, the remaining amount detection sensor including an element such as the differential transformer 82 may be used to detect variations in the permeability of the toner storage member and thereby detect the remaining amount of toner. However, a displacement of the position of the detection element may cause a significant variation in the output value. Then, it is necessary to enhance the accuracy of the detection of the remaining amount of toner. Hence, the output value (the empty output value D3) of the detection circuit 83 when the toner storage member of the toner is in the empty state (in the state where the toner is not left) is stored. Then, based on the empty output value D3, whether or not the toner storage member is in the empty state is determined. Thus, it is possible to accurately detect that the toner storage member enters the empty state. On the other hand, the substrate portion 7 can be attached while the position is being adjusted such that the output value of the detection circuit 83 when the toner storage member becomes empty is a predetermined empty output value D3. Hence, the detection circuit 83 can also be used as a sensor for detecting whether or not the position where the differential transformer 82 and the substrate portion 7 are attached is an appropriate position for accurately detecting the remaining amount of toner. Furthermore, in the present disclosure, when the position of the substrate portion 7 of a non-genuine product is displaced with respect to the genuine product, even if the empty output value D3 is stored in the toner container 1 of the non-genuine product, the empty output value D3 may not be appropriate. Hence, it is possible to prevent the same performance as the genuine product from being achieved. Thus, it is also possible to encourage the user to use the genuine product.

The memory 71 stores the remaining amount value D2 on the remaining amount of toner in the toner storage member (the toner container 1). When a new toner storage member is attached, the determination portion (the control portion 5) checks whether or not the difference between the output value of the detection circuit 83 and the remaining amount value D2 falls within the allowable range, and when the difference falls within the allowable range, the toner storage member is determined to be genuine whereas when the difference falls outside the allowable range, the toner storage member is determined not to be genuine.

When the position of the differential transformer 82 of a non-genuine product is displaced as compared with the genuine product, the difference between the output value of the detection circuit 83 and the remaining amount value D2 may be increased. Hence, by whether or not the difference between the output value of the detection circuit 83 of the toner storage member (the toner container 1) and the remaining amount value D2 falls within the appropriate range (the allowable range), it is possible to determine whether or not the attached toner storage member is genuine. Thus, it is possible to prevent an inferior toner stored in a non-genuine product from being mixed with the print portion 3 (the image formation portion 3*c* and the development device 4).

The initial value of the remaining amount value D2 is the output value of the detection circuit 83 when the toner storage member (the toner container 1) of the toner is in the filled state. The determination portion (the control portion 5) updates, according to the consumption of the toner, the remaining amount value D2 stored in the memory 71 of the toner storage member determined to be genuine. In this way, regardless of the amount of toner within the toner storage member of a non-genuine product, it is possible to determine whether or not the toner storage member is genuine.

Depending on the position where the substrate portion 7 is placed, even when a small amount of toner is left within the toner storage member (the toner container 1), the output value of the detection circuit 83 may reach the lower limit value. Hence, after the output value of the detection circuit 83 reaches the empty output value D3, the memory 71 stores the allowable number of sheets D4 which is the allowable number of sheets to be printed. After the output value of the detection circuit 83 reaches the empty output value D3, the determination portion (the control portion 5) determines, when the printing of the allowable number of sheets D4 is performed by the print portion 3, that the toner storage member (the toner container 1) is in the empty state.

In this way, after the toner in the toner storage member (the toner container 1) is almost used up, the toner storage member is determined to be in the empty state. Thus, it is possible to accurately determine the toner empty state. Although the empty state is detected, printing is not prevented immediately, and a given amount of printing is allowed, with the result that it is possible to enhance the usability of the image forming apparatus (the printer 100).

When the memory 71 does not store the empty output value D3, the determination portion (the control portion 5) determines that the toner storage member (the toner container 1) is not genuine. In this way, even if it is determined by checking the security information D1 that the toner storage member is genuine, it is possible to determine, based on the other information of the empty output value D3, whether or not the toner storage member is genuine. Thus, it is possible to accurately determine whether or not the toner storage member is genuine.

When the determination portion (the control portion 5) determines that the toner storage member (the toner container 1) is not genuine, the determination portion makes the notification portion notify information that the toner storage member attached to the notification portion (the display panel 20) is not genuine. In this way, it is possible to notify the user of the information that the toner storage member is not genuine. It is also possible to encourage the use of the genuine product.

Any one of the terminal provided in the terminal portion 9 and the terminal in the communication terminal portion 72 is the plate spring 90. In this way, it is possible to easily and reliably connect a new substrate and the determination portion such that they can communicate with each other.

In the substrate portion 7, as a circuit pattern, the differential transformer 82 is provided. A plurality of patterns of the position where the substrate portion 7 is attached or the position where the differential transformer 82 is formed within the substrate portion 7 are provided. As described above, a plurality of patterns are prepared, and thus it is possible to produce variations in the empty output value D3 of each toner storage member (the toner container 1). Hence, in a counterfeit product, even though the toner is left, the toner storage member may be determined to be in the empty state. This makes it difficult to manufacture a counterfeit product having the same performance as the genuine product.

The present disclosure can be regarded as the following toner storage member: a toner storage member is used in the image forming apparatus (the printer 100) described above and includes the memory 71, the remaining amount detection portion 8 for detecting the remaining amount of toner left, the communication terminal portion 72 and the substrate portion 7 which is one substrate, the memory 71 stores the security information D1 for determining whether or not the toner storage member is genuine, the remaining amount detection portion 8 includes the differential transformer 82 and the detection circuit 83 for processing the output of the differential transformer 82, the communication terminal portion 72 transmits the details stored in the memory 71 to the determination portion (the control portion 5) and transfers the output value of the detection circuit 83 and the memory 71 stores the security information D1 and the empty output value D3 indicating the output value of the detection circuit 83 when the toner storage member (the toner container 1) is in the empty state. In this way, it is possible to obtain the same effects as those described above.

When it is impossible to communicate with the substrate portion 7, and the presence of the substrate portion 7 is not recognized, the control portion 5 determines that the toner storage member (the toner container 1) is not present or is in the empty state. In this way, it is possible to prevent toner from flowing into the development device 4 from an inferior counterfeit product to which the substrate portion 7 is not attached.

Another embodiment will then be described. In the embodiment described above, as the image forming apparatus, the printer 100 is illustrated. However, the image forming apparatus may be a multifunctional peripheral, a copying machine, a facsimile machine or the like. In the embodiment described above, an example where the developer used in the development of an electrostatic latent image is one-component developer is described. However, the present disclosure can be applied to an image forming apparatus and a toner container 1 that use a two-component developer.

Although the embodiments of the present disclosure are described above, the scope of the present disclosure is not limited to them, and various modifications are possible without departing from the spirit of the disclosure.

What is claimed is:

1. An image forming apparatus comprising:

a print portion which performs printing with a toner;

a toner storage member which is removable with respect to the image forming apparatus, to which a substrate portion is attached and which supplies the toner to the print portion;

a terminal portion which communicates with the substrate portion;

a determination portion which determines, based on information received via the terminal portion from the substrate portion in the toner storage member, whether or not the toner storage member is a genuine product and which detects a remaining amount of the toner in the toner storage member; and a notification portion which notifies a state of the apparatus, wherein the substrate portion is one substrate, and includes, on the one substrate, a memory, a remaining amount detection portion which detects the remaining amount of toner, and a communication terminal portion, the remaining amount detection portion includes a differential transformer and a detection circuit which processes an output of the differential transformer, the memory stores security information determines whether or not the toner storage member is the genuine product and an empty output value indicating an output value of the detection portion when the toner storage member is in an empty state, the communication terminal portion transmits details stored in the memory and delivers the output value of the detection circuit to the determination portion, the determination portion recognizes a magnitude of the output value of the detection circuit and compares the empty output value stored in the memory with the output value of the detection circuit to determine whether or not the toner storage member is in the empty state, and when the determination portion determines that the toner storage member is in the empty state, the notification portion notifies that the toner storage member is empty.

2. The image forming apparatus according to claim 1, wherein the memory stores a remaining amount value on the remaining amount of the toner in the toner storage member, and when a new toner storage member is attached, the determination portion checks whether or not a difference between the output value of the detection circuit and the remaining amount value falls within an allowable range, and when the difference falls within the allowable range, the determination portion determines that the toner storage member is the genuine product whereas when the difference falls outside the allowable range, the determination portion determines that the toner storage member is not the genuine product.

3. The image forming apparatus according to claim 2, wherein an initial value of the remaining amount value is the output value of the detection circuit when the toner storage member is filled with the toner, and the determination portion updates, according to consumption of the toner, the remaining amount value stored in the memory of the toner storage member determined to be the genuine product.

4. The image forming apparatus according to claim 1, wherein the memory stores an allowable number of sheets which is an allowable number of sheets to be printed after the output value of the detection circuit reaches the empty output value, and the determination portion determines that the toner storage member is in the empty state when the allowable number of sheets are printed by the print portion after the output value of the detection circuit reaches the empty output value.

5. The image forming apparatus according to claim 1, wherein when the memory does not store the empty output value, the determination portion determines that the toner storage member is not the genuine product.

6. The image forming apparatus according to claim 2, wherein when the determination portion determines that the toner storage member is not the genuine product, the determination portion makes the notification portion notify that the attached toner storage member is not the genuine product.

7. The image forming apparatus according to claim 5, wherein when the determination portion determines that the toner storage member is not the genuine product, the determination portion makes the notification portion notify that the attached toner storage member is not the genuine product.

8. The image forming apparatus according to claim 1, wherein any one of a terminal provided in the terminal portion and a terminal in the communication terminal portion is a plate spring.

9. An image forming apparatus comprising:

a print portion which performs printing with a toner;

a toner storage member which is removable with respect to the image forming apparatus, to which a substrate portion is attached and which supplies the toner to the print portion;

a terminal portion which communicates with the substrate portion;

a determination portion which determines, based on information received with the terminal portion from the substrate portion in the toner storage member, whether or not the toner storage member is a genuine product and which detects a remaining amount of the toner in the toner storage member; and a notification portion which notifies a state of the apparatus, wherein the substrate portion is one substrate, and includes, on the one substrate, a memory, a remaining amount detection portion which detects the remaining amount of toner, and a communication terminal portion, the remaining amount detection portion includes a differential transformer and a detection circuit which processes an output of the differential transformer, the memory stores security information determines whether or not the toner storage member is the genuine product and an empty output value indicating an output value of the detection portion when the toner storage member is in an empty state, the communication terminal portion transmits details stored in the memory and for delivering the output value of the detection circuit to the determination portion, the determination portion recognizes a magnitude of the output value of the detection circuit and compares the empty output value stored in the memory with the output value of the detection circuit to determine whether or not the toner storage member is in the empty state, when the determination portion determines that the toner storage member is in the empty state, the notification portion notifies that the toner storage member is empty wherein in the substrate portion, as a circuit pattern, the differential transformer is provided, and a plurality of patterns of a position where the substrate portion is attached or a position where the differential transformer is formed within the substrate portion are prepared.

10. The image forming apparatus according to claim 1, wherein when it is impossible to communicate with the substrate portion and to recognize the presence of the substrate portion, the determination portion determines that the toner storage member is not present or that the toner storage member is in the empty state.

11. The image forming apparatus according to claim 2, wherein when the remaining amount value cannot be read or an abnormal remaining amount value is read, the determination portion determines that the attached toner storage member is not the genuine product.

12. The image forming apparatus according to claim 1, wherein when the security information cannot be acquired from the memory or when the acquired security information does not follow a specification so as to be abnormal, the determination portion determines that the attached toner storage member is not the genuine product.

13. A toner storage member that is used in the image forming apparatus according to claim 1 and that comprises:

a substrate portion which is one substrate which includes the communication terminal portion, the remaining amount detection portion and the memory, wherein the memory stores the security information for determining whether or not the toner storage member is the genuine product, the remaining amount detection portion includes the differential transformer and the detection circuit which processes the output of the differential transformer, the communication terminal portion transmits the details stored in the memory and transfers the output value of the detection circuit, and the memory stores the security information and the empty output value indicating the output value of the detection portion when the toner storage member is in the empty state.

14. A method of controlling an image forming apparatus, the method comprising:

performing printing with a toner;

attaching a toner storage member to the image forming apparatus such that the toner storage member is removable with respect to the image forming apparatus;

supplying the toner by the toner storage member;

attaching a substrate portion to the toner storage member, the substrate portion being one substrate and including, on the one substrate, a memory, a remaining amount detection portion including a differential transformer and a detection circuit which processes an output of the differential transformer, and a communication terminal portion, the communication terminal portion transmitting details stored in the memory and for delivering the output value of the detection circuit;

determining, based on information received from the substrate portion in the toner storage member, whether or not the toner storage member is genuine and detecting the remaining amount of the toner in the toner storage member;

storing, in the memory, the security information for determining whether or not the toner storage member is genuine and an empty output value indicating an output value of the detection circuit when the toner storage member is in an empty state;

recognizing a magnitude of the output value of the detection circuit and comparing the empty output value stores in the memory with the output value of the detection circuit to determine whether or not the toner storage member is in the empty state; and notifying, when the toner storage member is in the empty state, that the toner storage member is empty.

* * * * *